US011413648B2

(12) United States Patent
Kim et al.

(10) Patent No.: US 11,413,648 B2
(45) Date of Patent: Aug. 16, 2022

(54) SLOT DIE WITH VARIABLE MANIFOLDS AND CONTROLLING METHOD THEREOF

(71) Applicant: SUNG AN MACHINERY CO., LTD., Hwaseong-si (KR)

(72) Inventors: Yong Sung Kim, Anseong-si (KR); Jin Woo Seong, Ansan-si (KR); Young Jin Kim, Suwon-si (KR)

(73) Assignee: SUNG AN MACHINERY CO., LTD., Hwaseong-si (KR)

( * ) Notice: Subject to any disclaimer, the term of this patent is extended or adjusted under 35 U.S.C. 154(b) by 830 days.

(21) Appl. No.: 16/095,108

(22) PCT Filed: Mar. 9, 2018

(86) PCT No.: PCT/KR2018/002806

§ 371 (c)(1),
(2) Date: Oct. 19, 2018

(87) PCT Pub. No.: WO2018/199464

PCT Pub. Date: Nov. 1, 2018

(65) Prior Publication Data

US 2020/0353500 A1 Nov. 12, 2020

(30) Foreign Application Priority Data

Apr. 26, 2017 (KR) ..... 10-2017-0053962

(51) Int. Cl.
*B05C 5/02* (2006.01)
*B05C 11/10* (2006.01)
(Continued)

(52) U.S. Cl.
CPC ..... *B05C 5/0254* (2013.01); *B05C 11/1002* (2013.01); *B05D 1/26* (2013.01); *B41F 31/08* (2013.01)

(58) Field of Classification Search
None
See application file for complete search history.

(56) References Cited

U.S. PATENT DOCUMENTS

2004/0139913 A1* 7/2004 Kuromiya ..... B29C 48/07 118/668
2008/0274223 A1* 11/2008 Cloeren ..... B29C 48/2566 425/133.5

(Continued)

FOREIGN PATENT DOCUMENTS

JP 01-105744 A 4/1989
JP 2005-034748 A 2/2005

(Continued)

OTHER PUBLICATIONS

English translation for JP2009-273997.*

*Primary Examiner* — Charles Capozzi
(74) *Attorney, Agent, or Firm* — Novick, Kim & Lee, PLLC; Sang Ho Lee; Hyun Woo Shin

(57) ABSTRACT

Provided is a slot die with variable manifolds and a controlling method thereof. The slot die with the variable manifolds, which applies ink on a substrate to perform a coating process, includes: a first body having a length corresponding to a width of the substrate and having a cavity configured to accommodate the ink supplied from the outside; a second body having a length corresponding to the first body and having an discharge port, from which the ink is discharged, formed in one side thereof when the second body is coupled to the first body; a plurality of variable manifolds disposed in the cavity in a width direction of the substrate and installed so as to reciprocate in the cavity; and a plurality of manifold drivers disposed at one side of the first body and connected to the plurality of variable manifolds to allow the plurality of variable manifolds to reciprocate, respectively, wherein each of the plurality of variable (Continued)

manifolds is independently driven according to a state of the ink coated on the substrate and adjusts a partial discharge amount of the ink discharged from the discharge port by changing a partial volume of the cavity at an arrangement position thereof.

10 Claims, 12 Drawing Sheets

(51) Int. Cl.
*B05D 1/26* (2006.01)
*B41F 31/08* (2006.01)

(56) References Cited

U.S. PATENT DOCUMENTS

| | | | | |
|---|---|---|---|---|
| 2011/0086164 | A1* | 4/2011 | Lang | B05C 5/0254 427/58 |
| 2012/0027942 | A1* | 2/2012 | Joos | B29C 48/305 427/421.1 |
| 2014/0186530 | A1 | 7/2014 | Harris et al. | |
| 2015/0224700 | A1* | 8/2015 | Loukusa | B29C 48/302 425/141 |

FOREIGN PATENT DOCUMENTS

| | | | |
|---|---|---|---|
| JP | 2009-273997 | A | 11/2009 |
| KR | 10-2016-0038534 | A | 4/2016 |

* cited by examiner

SLOT DIE WITH VARIABLE MANIFOLDS AND CONTROLLING METHOD THEREOF

TECHNICAL FIELD

The present invention relates to a slot die with variable manifolds and a controlling method thereof, and more particularly, to a slot die with variable manifold, capable of improving coating uniformity of ink in a width direction of a substrate, and a controlling method thereof.

BACKGROUND ART

Recently, printed electronics technology that manufactures electronic devices by forming various patterns by printing functional ink (hereinafter, collectively referred to as ink) on various types of substrates has attracted attention.

Such printed electronics technology has an advantage that the manufacturing process is not complicated, as compared with photolithography technology that has been used for forming patterns on a substrate in the past. Furthermore, a roll-to-roll printing apparatus, which prints ink on a roll-shaped film or web (hereinafter, collectively referred to as a film) continuously supplied, further increases production efficiency of electronic devices by rapid production speed due to a continuous process.

In general, the roll-to-roll printing apparatus performs a coating process of applying ink on a film so as to perform a printing process on the film. Such a coating process may be performed by a gravure method, a rotary screen method, a slot die method, or the like. Among them, the coating method using a slot die has advantages in that coating can be performed on a wide width of a substrate all at once, there is no change in ink viscosity, a foreign material is not introduced, and the reproducibility of ink coating is excellent.

Meanwhile, printing accuracy is very important so as to manufacture an electronic device by using printed electronics technology for printing ink on a substrate. In general, an electronic device requires a printing accuracy of several to several tens of microns (μm) according to an object to which the electronic device is applied.

In general, a slot die, which performs a slot die coating process, requires ink to be thinly and uniformly applied on a substrate so as to improve the printing accuracy of an electronic device. To this end, it is important to quantitatively adjust ink supplied to the slot die and to coat a thin ink film to a desired thickness by adjusting a gap between the slot die and the substrate according to a coating process condition such as a type, transfer speed, or the like of the substrate.

However, in the conventional slot die, when a gap between the slot die and the substrate is adjusted and a supply amount or an discharge amount of ink is adjusted, the ink coated on the substrate is not uniform in a width direction of the substrate (length direction of the slot die) as a whole.

In addition, in the conventional slot die, when a foreign material is introduced into an discharge port, after the whole of the slot die is disassembled and the foreign is removed, the slot die should be assembled and set again, resulting in difficulty in maintenance.

Therefore, there is a need for slot die capable of improving coating uniformity of ink in a width direction of a substrate and improving convenience of maintenance.

SUMMARY OF INVENTION

Technical Problem

The present invention has been made in an effort to solve the above problems, and an object of the present invention is to provide a slot die with variable manifolds, capable of improving coating uniformity of ink in a width direction of a substrate by independently driving each of a plurality of variable manifolds according to a state of the ink coated on a substrate during a substrate coating process and controlling a partial discharge amount of the ink.

The technical objects of the present invention are not limited to the above-mentioned object, and other technical objects will be clearly understood from the following description by those skilled in the art.

Solution to Problem

In order to achieve the above objects, a slot die with variable manifolds, which applies ink on a substrate to perform a coating process, includes: a first body having a length corresponding to a width of the substrate and having a cavity configured to accommodate the ink supplied from the outside; a second body having a length corresponding to the first body and having an discharge port, from which the ink is discharged, formed in one side thereof when the second body is coupled to the first body; a plurality of variable manifolds disposed in the cavity in a width direction of the substrate and installed so as to reciprocate in the cavity; and a plurality of manifold drivers disposed at one side of the first body and connected to the plurality of variable manifolds to allow the plurality of variable manifolds to reciprocate, respectively, wherein each of the plurality of variable manifolds is independently driven according to a state of the ink coated on the substrate and adjusts a partial discharge amount of the ink discharged from the discharge port by changing a partial volume of the cavity at an arrangement position thereof.

Each of the plurality of variable manifolds includes a movement block disposed in the cavity so as to reciprocate in a direction toward the discharge port; and a position adjustment portion having one end connected to the movement block and the other end connected to each of the plurality of manifold drivers and configured to adjust a position of the movement block by using a driving force supplied from each of the plurality of manifold drivers, wherein, when the position in the cavity is changed by the position adjustment portion, the movement block changes the partial volume of the cavity at an arrangement position thereof.

Each of the plurality of manifold drivers is a first driving actuator configured to generate a rotational driving force, and the position adjustment portion is a ball screw member having one end connected to the movement block and the other end connected to a rotary drive shaft of the first driving actuator.

Each of the plurality of manifold drivers is a second driving actuator configured to generate a linear driving force, and the position adjustment portion is a drive shaft member having one end connected to the movement block and the other end connected to a linear drive shaft of the second driving actuator.

At least one of the first body and the second body has at least one ink supply hole formed in one side thereof, which is configured to supply the ink supplied from the outside to the cavity.

The at least one ink supply hole communicates with a lower portion of the cavity with respect to each of the plurality of variable manifolds, and each of the plurality of variable manifolds changes a partial volume of the lower portion of the cavity at an arrangement position thereof.

The at least one ink supply hole communicates with an upper portion of the cavity with respect to each of the plurality of variable manifolds, and each of the plurality of variable manifolds concurrently changes partial volumes of the upper portion and a lower portion of the cavity at an arrangement position thereof.

The movement block provided in each of the plurality of variable manifolds has at least one ink path formed in at least one of a width direction of the first body, a length direction of the first body, and the direction toward the discharge port.

The slot die further includes a shim plate disposed between the first body and the second body and having one or more slits which communicate with the cavity and are open a direction toward the discharge port.

In order to achieve the above objects, a control method of a slot die with variable manifolds which applies ink on a substrate to perform a coating process includes: starting, by the slot die, a coating process of applying the ink on the substrate; measuring, by a profile measurement unit, a cross-sectional profile of the ink while the coating process is performed; comparing, by a controller, the cross-sectional profile measured through the profile measurement unit with a reference profile; calculating, by the controller, a partial error amount between the cross-sectional profile and the reference profile at a preset interval in a width direction of the substrate; and adjusting, by the controller, a partial discharge amount of the ink discharged from the slot die at the present interval based on the partial error amount calculated at the preset interval, wherein the slot die includes a first body having a length corresponding to a width of the substrate and having a cavity configured to accommodate the ink supplied from the outside; a second body having a length corresponding to the first body and having an discharge port, from which the ink is discharged, formed in one side thereof when the second body is coupled to the first body; a plurality of variable manifolds disposed in the cavity in the width direction of the substrate and installed so as to reciprocate in the cavity; and a plurality of manifold drivers disposed at one side of the first body and connected to the plurality of variable manifolds to allow the plurality of variable manifolds to reciprocate, respectively, and wherein the adjusting, by the controller, the partial discharge amount of the ink discharged from the slot die includes adjusting, by the controller, the partial discharge amount of the ink discharged from the discharge port by controlling the plurality of manifold drivers to independently drive the plurality of variable manifolds and to change a partial volume of the cavity at an adjustment position of each of the plurality of variable manifolds based on the partial error amount calculated at the preset interval.

Specific matters of the embodiments are included in the detailed description and the drawings.

Advantageous Effects of Invention

According to a slot die with variable manifolds and a controlling method thereof according to an embodiment of the present invention, each of a plurality of variable manifolds may be independently driven according to a state of ink coated on a substrate during a substrate coating process to control a partial discharge amount of the ink, thereby improving coating uniformity of the ink in a width direction of a substrate.

The effects of the present invention are not limited to the effects mentioned above, and other effects can be clearly understood from the description of the claims by those skilled in the art.

BEST MODE FOR CARRYING OUT THE INVENTION

Figure 1:
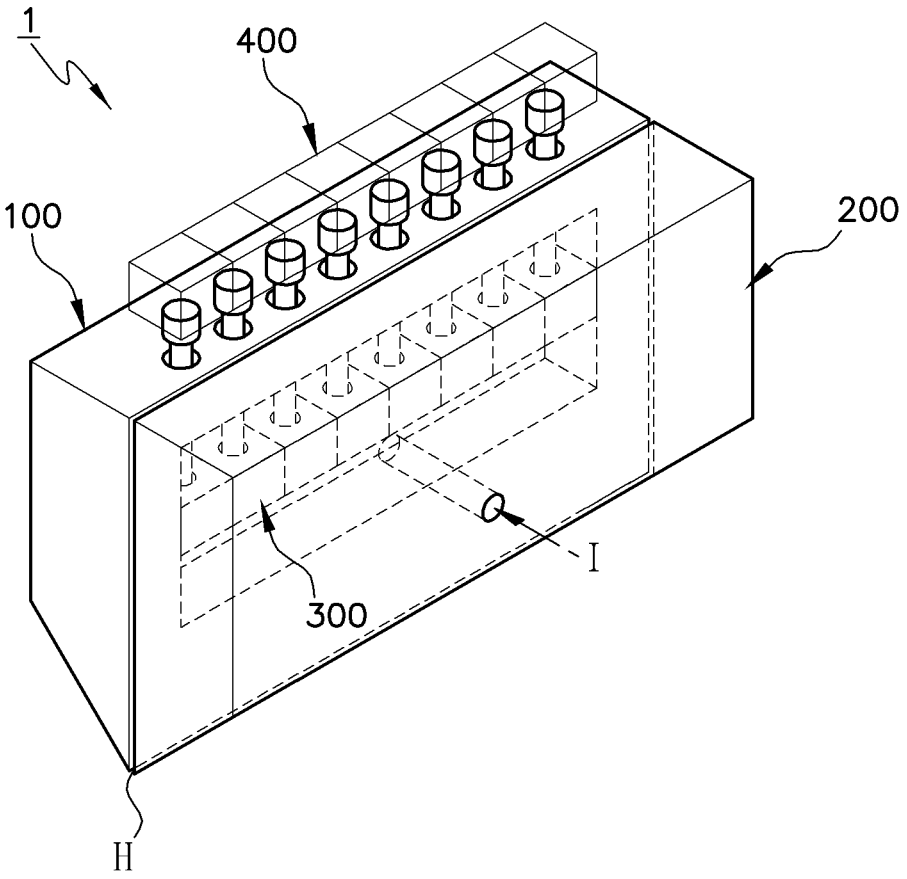
FIG. 1 is a perspective view illustrating a structure of a slot die with variable manifolds according to a first embodiment of the present invention.

According to a best mode of the present invention, a slot die with variable manifolds, which applies ink on a substrate to perform a coating process, includes a first body having a length corresponding to a width of the substrate and having a cavity configured to accommodate the ink supplied from the outside; a second body having a length corresponding to the first body and having an discharge port, from which the ink is discharged, formed in one side thereof when the second body is coupled to the first body; a plurality of variable manifolds disposed in the cavity in a width direction of the substrate and installed to reciprocate in the cavity;

and a plurality of manifold drivers disposed at one side of the first body and connected to the plurality of variable manifolds to allow the plurality of variable manifolds to reciprocate, respectively.

Each of the plurality of variable manifolds is independently driven according to a state of the ink coated on the substrate and adjusts a partial discharge amount of the ink discharged from the discharge port by changing a partial volume of the cavity at an arrangement position thereof.

Description of Embodiments

Hereinafter, preferred embodiments of the present invention will be described in detail with reference to the accompanying drawings so that they can be readily implemented by those skilled in the art.

A description of technical content that is well known to those skilled in the art and is not directly related to the present invention is omitted when embodiments of the present invention are described. The reason for this is to omit unnecessary description, and to more definitely transmit the gist of the present invention rather than making the gist of the present invention unclear.

For the same reason, some components in the drawings are exaggeratedly shown, omitted, or schematically shown. The sizes of respective components in the drawings do not reflect actual sizes. The same or similar reference symbols are used throughout the drawings to refer to the same or like parts.

Hereinafter, the present invention will be described with reference to the drawings illustrating a slot die with variable manifolds and a controlling method thereof through embodiments of the present invention.

Figure 2:
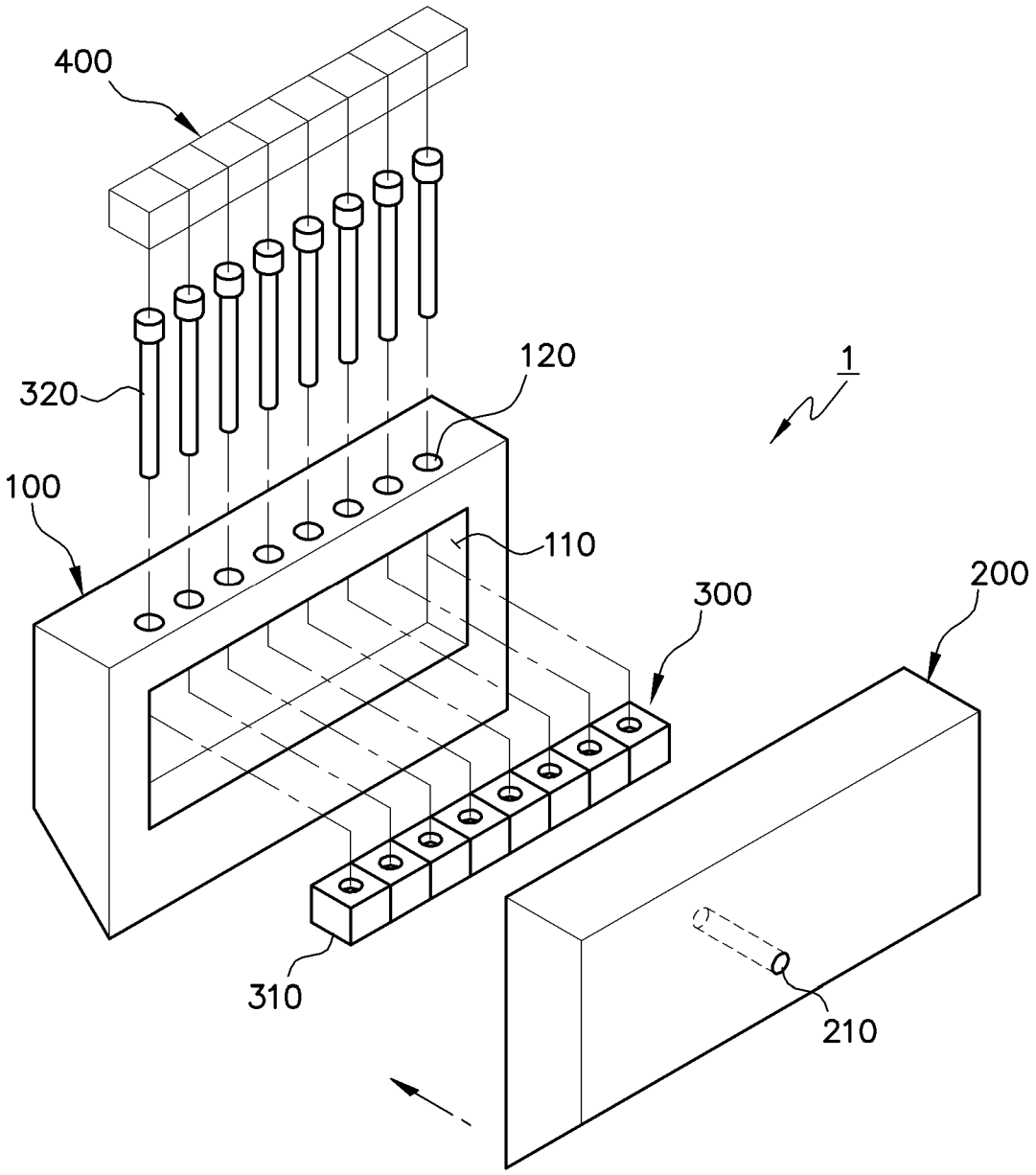
FIG. 2 is an exploded perspective view illustrating the structure of the slot die with the variable manifolds according to the first embodiment of the present invention.
Figure 3:
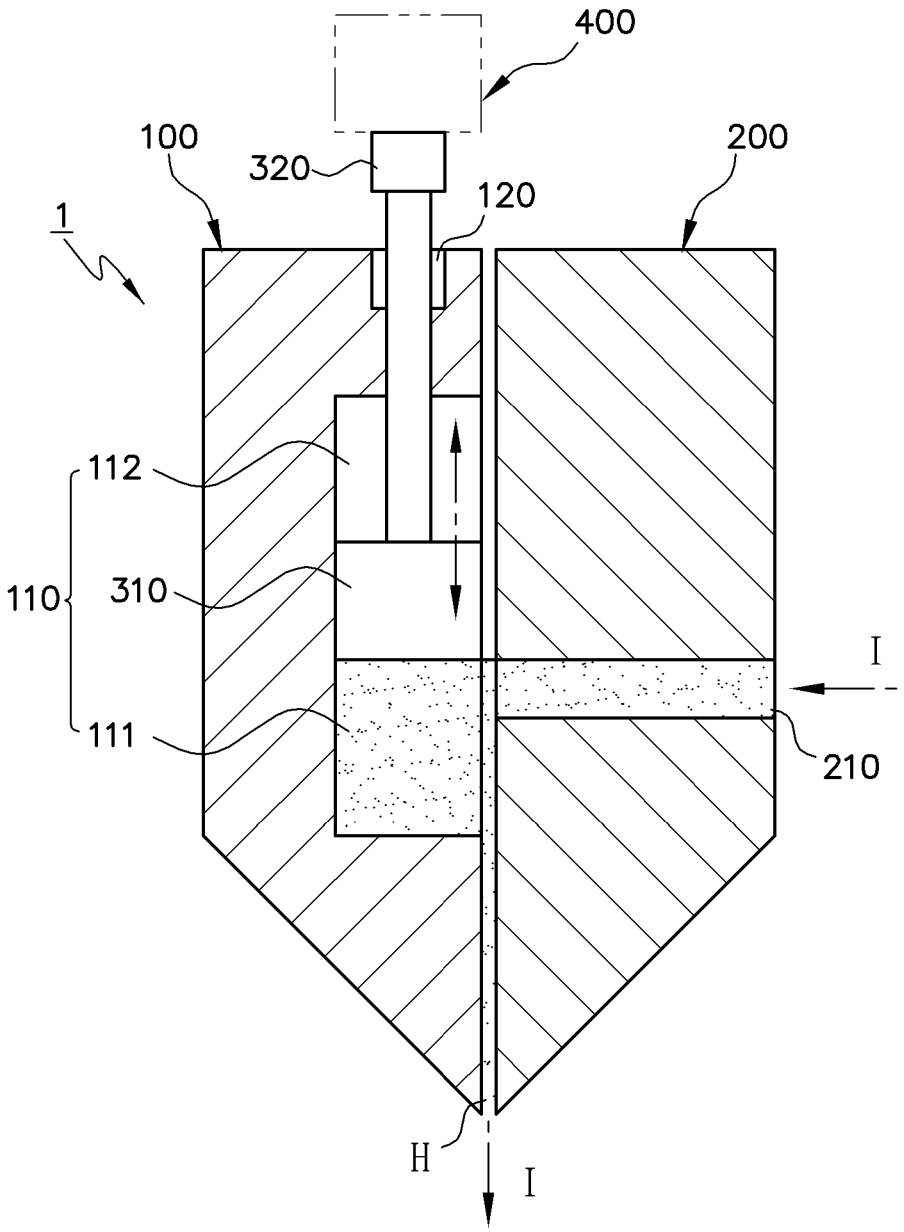
FIG. 3 is a longitudinal sectional view illustrating the structure of the slot die with the variable manifolds according to the first embodiment of the present invention.

FIG. 1 is a perspective view illustrating a structure of a slot die with variable manifolds according to a first embodiment of the present invention. FIG. 2 is an exploded perspective view illustrating the structure of the slot die with the variable manifolds according to the first embodiment of the present invention. FIG. 3 is a longitudinal sectional view illustrating the structure of the slot die with the variable manifolds according to the first embodiment of the present invention.

As illustrated in FIGS. 1 to 3, a slot die 1 with variable manifolds according to the first embodiment of the present invention may include a first body 100, a second body 200, a plurality of variable manifolds 300, and a plurality of manifold drivers 400.

The first body 100 may have a length corresponding to a width of a substrate (S of FIG. 10), and a cavity 110, in which ink I supplied from the outside is accommodated, may be formed in the first body 100. The second body 200 may have a length corresponding to the first body 100 and may have an discharge port H, from which the ink I is discharged, formed in one side thereof when the second body 200 is coupled to the first body 100.

As illustrated in FIGS. 1 and 2, the first body 100 and the second body 200 may each be elongated to have a length corresponding to the width of the substrate and to have a cross section which becomes gradually narrower toward a lower portion thereof.

In addition, the discharge port H may be formed in a lower end of the first body 100 and the second body 200 to communicate with the cavity 110 formed in the first body 100 and discharge the ink I accommodated in the cavity 110 toward the substrate. The discharge port H may be elongated in a length direction of the first body 100 and the second body 200 and may determine a coating width of the ink I discharged to the substrate.

Meanwhile, at least one of the first body 100 and the second body 200 may have at least one ink supply hole 210 formed in one side thereof, which is configured to supply the ink I supplied from an external ink storage tank (not shown) to the cavity 110.

FIG. 3 illustrates an example in which the ink supply hole 210 is formed only in one side of the second body 200. This is merely an example, and the ink supply hole may be formed only in one side of the first body 100 and may be formed in each of both the first body 100 and the second body 200. In addition, FIG. 3 illustrates an example in which one ink supply hole 210 is formed in a center of one side of the second body 200, but the number and position of the ink supply holes may be freely changed by a person skilled in the art.

Preferably, as illustrated in FIG. 3, when the ink supply hole 210 is formed in one side of the second body 200 (or the first body 100), the ink supply hole 210 may be formed to communicate with a lower portion of the cavity 110 with respect to each of the plurality of variable manifolds 300. Therefore, each of the plurality of variable manifolds 300 may change a partial volume of the lower portion of the cavity 110 at an arrangement position thereof.

The plurality of variable manifolds 300 may be disposed in the cavity 110 at certain intervals in a width direction of the substrate, perpendicular to a transfer direction (or a direction opposite to the transfer direction) of the substrate. Each of the variable manifolds 300 may be installed to reciprocate in the cavity 110 and may be individually driven by each of the manifold drivers 400.

FIGS. 1 and 2 illustrate an example in which the plurality of variable manifolds 300 are formed to have the same size and are disposed in a line at the same interval. However, this is merely an example, and the size, number, and arrangement type of the variable manifolds 300 may be freely changed according to various conditions such as the type of the substrate, the type of the ink I, and transfer speed of the substrate.

Meanwhile, each of the plurality of variable manifolds 300 constituting the slot die 1 with the variable manifolds according to the first embodiment of the present invention may be independently driven according to a state of the ink I to be coated on the substrate by each of the plurality of manifold drivers 400. Each of the plurality of variable manifolds 300 may change a partial volume of the cavity 110 at an arrangement position thereof to adjust a partial flow rate of the ink I and adjust a partial discharge amount of the ink I discharged from the discharge port H.

In particular, as illustrated in FIG. 3, when the ink supply hole 210 is formed in one side of the second body 200 (or the first body 100) so as to communicate with the lower portion of the cavity 110 with respect to each of the plurality of variable manifolds 300, each of the plurality of variable manifolds 300 may change a partial volume of the lower portion of the cavity, i.e., a first space 111 at an arrangement position thereof.

As illustrated in FIGS. 2 and 3, each of the variable manifolds 300 may include a movement block 310 and a position adjustment portion 320.

The movement block 310 may be disposed in the cavity 110 so as to reciprocate in a direction toward the discharge port H formed in the lower end of the first body 100 or the second body 200. As illustrated in FIG. 3, the movement block 310 may divide may divide may divide may divide may divide the cavity 110 into a first space 111 in which the ink I supplied from the outside is accommodated, and a second space 112 in which the ink I is not accommodated.

Meanwhile, although not illustrated, a guide member (not shown) configured to guide movement of the movement block 310 may be provided between the movement block 310 and an inner wall of the cavity 110.

The position adjustment portion 320 has one end connected to the movement block 310 and the other end connected to each of the plurality of manifold drivers 400 and may adjust a position of the movement block 310 by using a driving force supplied from each of the plurality of the manifold drivers 400.

As illustrated in FIGS. 2 and 3, the position adjustment portion 320 has a shaft shape elongated in a movement direction of the movement block 310. The position adjustment portion 320 may be inserted into and coupled to a through-hole 120 formed in the first body 100 and may have one end connected to the movement block 310 in a state of being positioned in the cavity 110 and the other end connected to the manifold driver 400 in a state of being exposed to the outside of the first body 100.

As illustrated in FIG. 3, when a position of the movement block 310 in the cavity 110 is changed by the position adjustment portion 320, the movement block 310 may change a partial volume of the lower portion of the cavity 110, i.e., the first space 111 at an arrangement position thereof.

On the other hand, the plurality of manifold drivers 400 may be disposed at one side of the first body 100 and may be connected to the plurality of variable manifolds 300 to allow the plurality of variable manifolds 300 to reciprocate, respectively.

Figure 4:
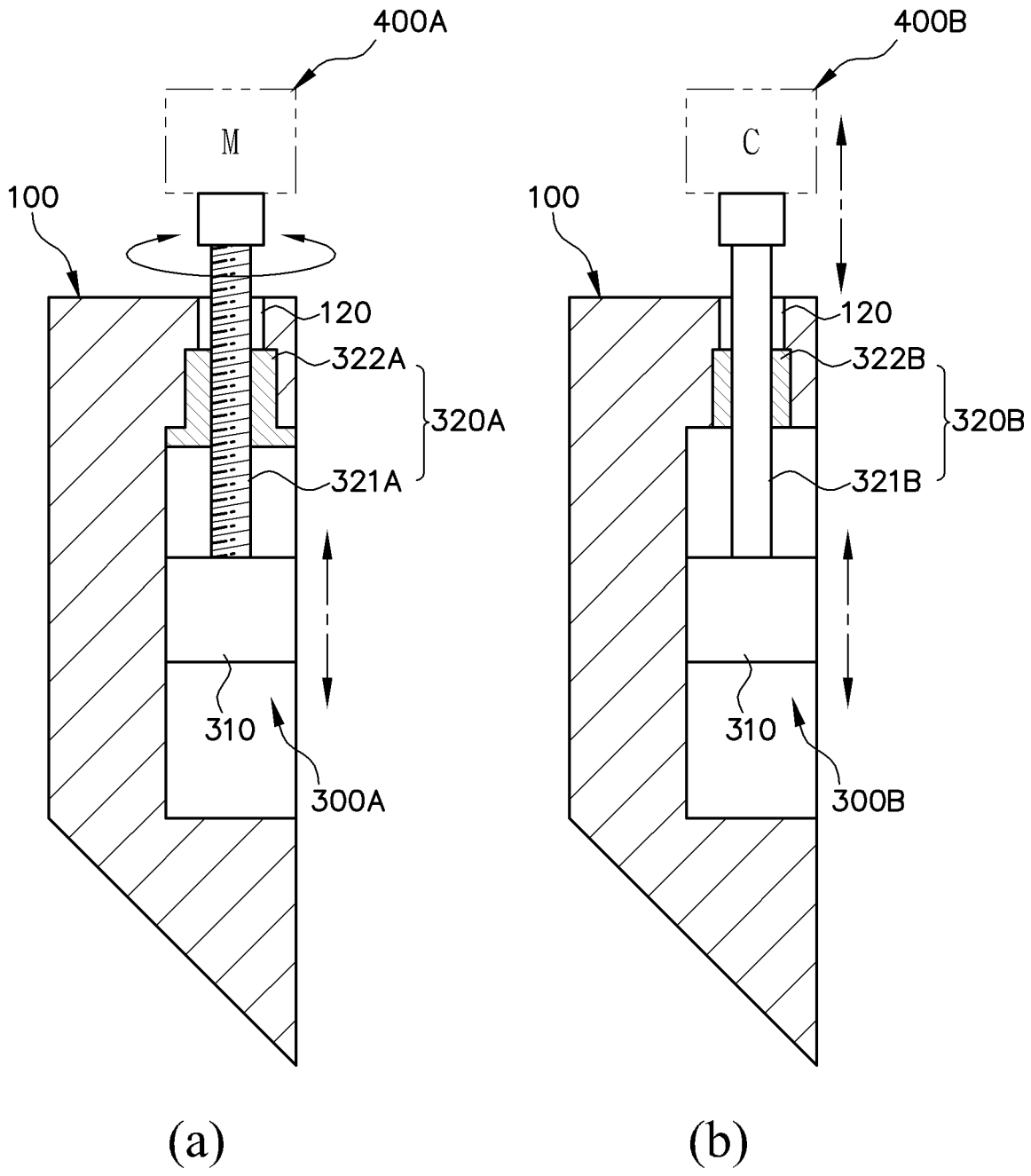
FIG. 4 is a view illustrating various examples of variable manifolds and manifold drivers constituting the slot die with the variable manifolds according to the first embodiment of the present invention.

FIG. 4 is a view illustrating various examples of variable manifolds and manifold drivers constituting the slot die with the variable manifolds according to the first embodiment of the present invention.

(a) of FIG. 4 illustrates an example in which variable manifolds 300A reciprocate by a rotational driving force, and (b) of FIG. 4 illustrates an example in which variable manifolds 300B reciprocate by a linear driving force.

First, as illustrated in (a) of FIG. 4, in order for the variable manifold 300A to reciprocate by a rotational driving force, a manifold driver 400A may be a first driving actuator M such as a stepping motor configured to generate a rotational driving force, and a position adjustment portion 320A may include a ball screw member having one end connected to a movement block 310 and the other end connected to a rotary drive shaft of the first driving actuator M.

That is, as illustrated in (a) of FIG. 4, the position adjustment portion 320A may include a screw member 321A having one end rotatably connected to the movement block 310 and the other end connected to a rotation shaft of the stepping motor M, and a nut member 322A coupled to a through-hole 120 formed in a first body 100 to allow the screw member 321A inserted therein to reciprocate.

Meanwhile, as illustrated in (b) of FIG. 4, in order for the variable manifold 300B to reciprocate by a linear driving force, a manifold driver 400B may be a second driving actuator C such as a pneumatic cylinder configured to generate a linear driving force, and a position adjustment portion 320B may be a drive shaft member having one end connected to a movement block 310 and the other end connected to a linear drive shaft of the second driving actuator C.

That is, as illustrated in (b) of FIG. 4, the position adjustment portion 320*b* may include a drive shaft 321B having one end connected to the movement block 310 and the other end connected to a drive shaft of the pneumatic cylinder, and a guide bush 322B coupled to a through-hole 120 formed in a first body 100 to guide movement of the drive shaft 321B inserted therein to reciprocate.

As described above, each of variable manifolds 300 constituting the slot die 1 with the variable manifolds according to the first embodiment of the present invention may be independently driven according to the state of the ink I to be coated on the substrate. Each of variable manifolds 300 may change a partial volume of the cavity 110 at an arrangement position thereof to adjust a partial flow rate of the ink I and adjust a partial discharge amount of the ink I discharged from the discharge port H.

Figure 5:
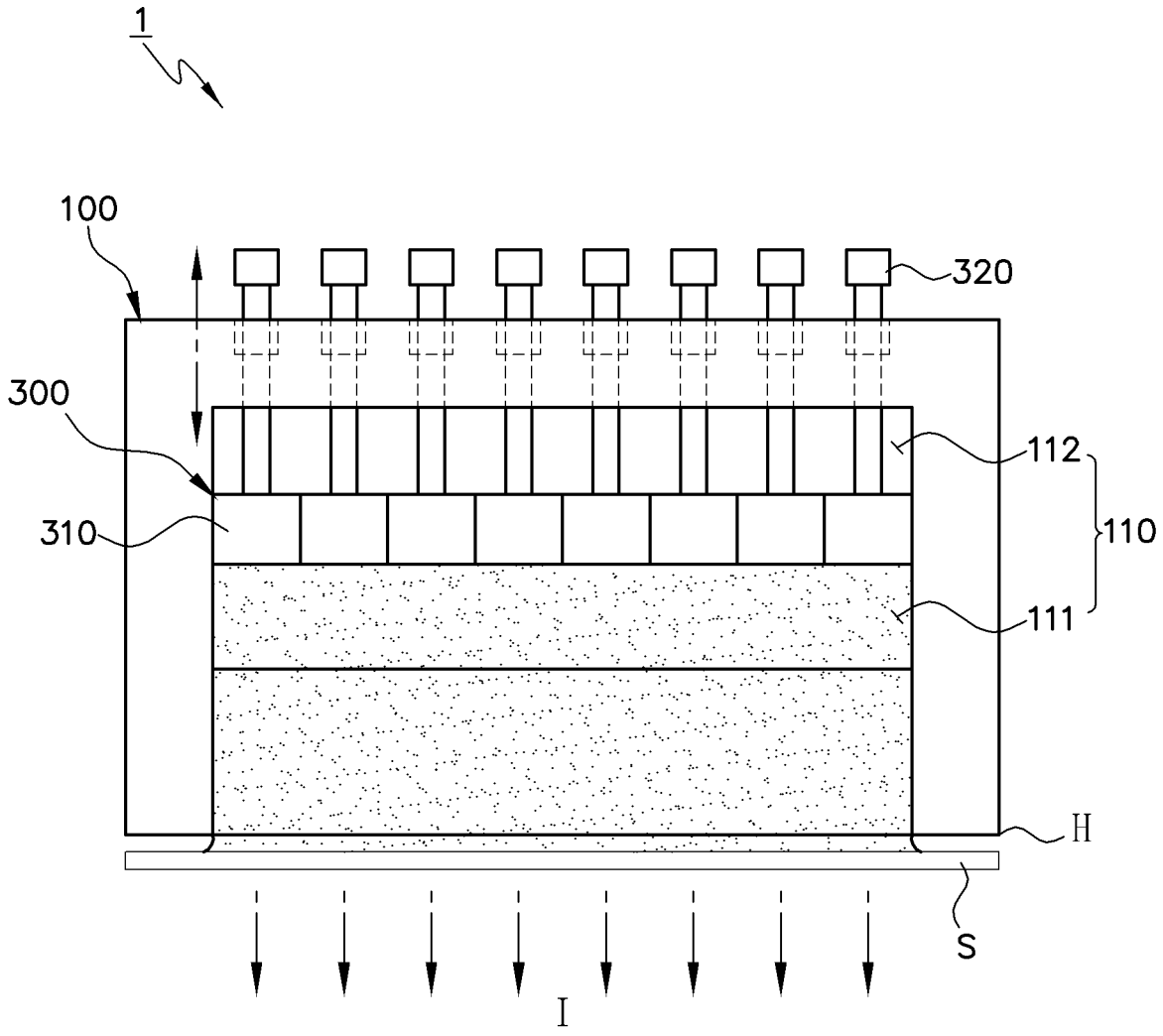
FIG. 5 is a view illustrating a state in which each of a plurality of variable manifolds constituting the slot die with the variable manifolds according to the first embodiment of the present invention is in an initial position.
Figure 6:
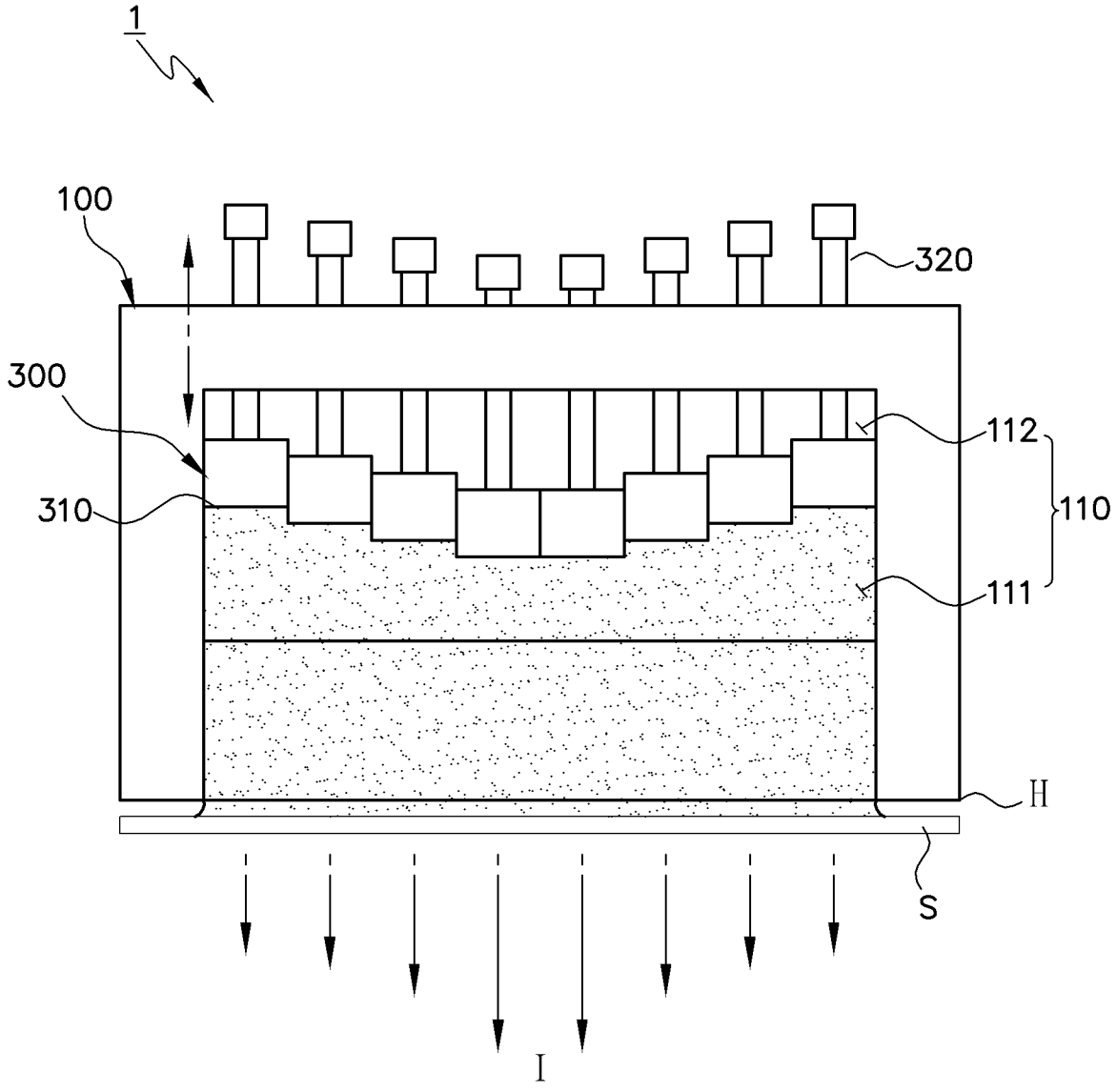
FIG. 6 is a view illustrating a state in which each of the plurality of variable manifolds constituting the slot die with the variable manifolds according to the first embodiment of the present invention is in an adjusted position.

FIG. 5 is a view illustrating a state in which each of the plurality of variable manifolds constituting the slot die with the variable manifolds according to the first embodiment of the present invention is in an initial position. FIG. 6 is a view illustrating a state in which each of the plurality of variable manifolds constituting the slot die with the variable manifolds according to the first embodiment of the present invention is in an adjusted position.

As illustrated in FIG. 5, when all of the plurality of variable manifolds 300 are positioned at the same height, the cavity 110 may have the same partial volumes at positions where the plurality of variable manifolds 300 are disposed in the length direction of the first body 100, thereby constantly maintaining an discharge amount of the ink I discharged from the discharge port H in the width direction of the substrate.

As illustrated in FIG. 6, when all or some of the plurality of variable manifolds 300 are positioned at different heights, the cavity 110 may have different partial volumes at positions where the plurality of variable manifolds 300 are disposed in the length direction of the first body 100, thereby differently adjusting discharge amounts of the ink I discharged from the discharge port H in the width direction of the substrate by differently adjusting partial flow rates of the ink I.

For example, in FIG. 6, when a height of a variable manifold 300 is low, a partial volume may be relatively small at a position where the variable manifold 300 is disposed. Thus, a partial flow rate of the ink I is increased, thereby increasing a partial discharge amount at the position where the variable manifold 300 is disposed.

Meanwhile, the slot die 1 with the variable manifolds according to the first embodiment of the present invention may further include a shim plate disposed between the first body 100 and the second body 200.

Figure 7:
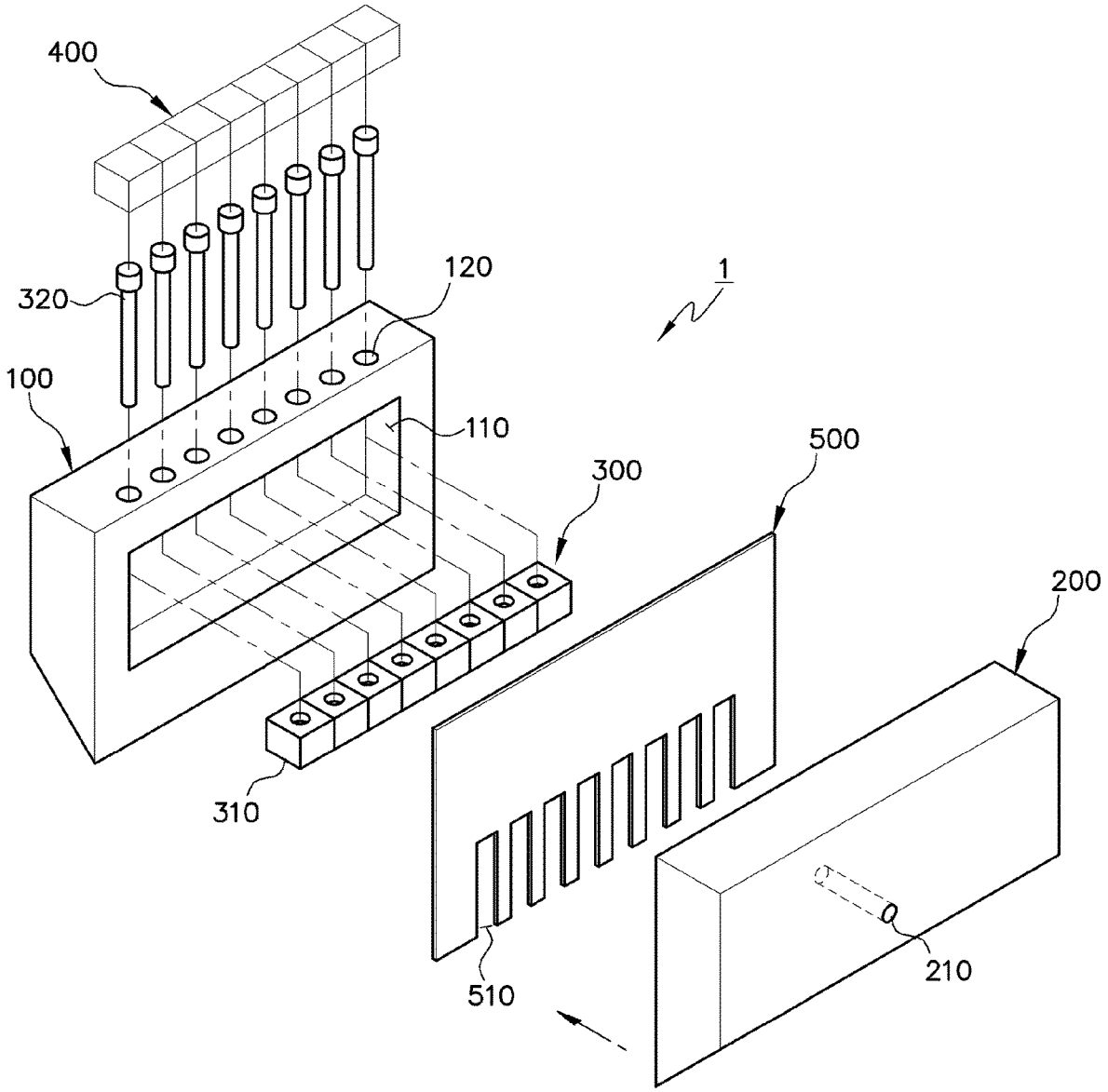
FIG. 7 is an exploded perspective view illustrating a state in which the slot die with the variable manifolds according to the first embodiment of the present invention includes a shim plate.

FIG. 7 is an exploded perspective view illustrating a state when the slot die with the variable manifolds according to the first embodiment of the present invention includes the shim plate.

As illustrated in FIG. 7, a shim plate 500 may be made of a metal material having a thin plate shape formed substantially the same as a surface on which the first body 100 and the second body 200 are coupled. The shim plate 500 may be interposed and coupled between the first body 100 and the second body 200.

As illustrated in FIG. 7, the shim plate 500 may have one or more slits 510 formed therein, of which each have an upper end communicating with the cavity 110 formed in the first body 100 and which are each open in a lower direction toward the discharge port H. FIG. 7 illustrates an example in which the shim plate 500 has a plurality of slits 510 having the same size, which are formed at the same interval in the width direction of the substrate. However, the size, number, and arrangement type of the slits 510 may be freely changed by a person skilled in the art.

As described above, in the slot die 1 with the variable manifolds according to the first embodiment of the present invention, the shim plate 500 may be disposed between the first body 100 and the second body 200, thereby further improving coating uniformity of the ink I in the width direction of the substrate.

Hereinafter, a structure of a slot die 1 with variable manifolds according to a second embodiment of the present invention will be described with reference to FIGS. 8 and 9. For convenience of description, descriptions of the same structures as those of the first embodiment illustrated in FIGS. 1 to 7 will be omitted, and only differences will be mainly described below.

Figure 8:
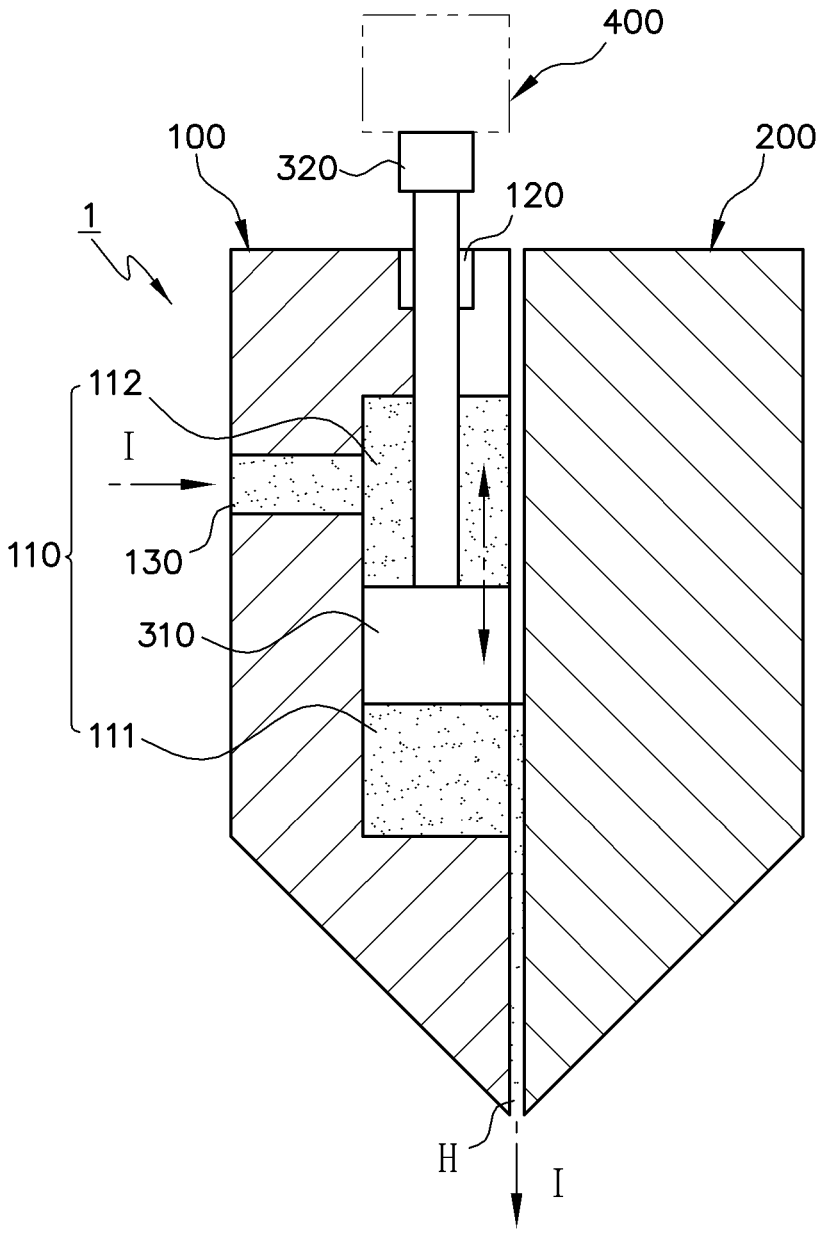
FIG. 8 is a longitudinal sectional view illustrating a structure of a slot die with variable manifolds according to a second embodiment of the present invention.

FIG. 8 is a longitudinal sectional view illustrating the structure of the slot die with the variable manifolds according to the second embodiment of the present invention.

A slot die 1 with variable manifolds according to the second embodiment of the present invention illustrated in FIG. 8 differs from the first embodiment of the present invention in that an ink supply hole 130 is formed so as to communicate with an upper portion of a cavity 110.

That is, as illustrated in FIG. 8, the ink supply hole 130 may be formed to communicate with the upper portion, i.e., a second space 112 of the cavity 110 with respect to each of a plurality of variable manifolds 300.

FIG. 8 illustrates an example in which the ink supply hole 130 is formed only in one side of a first body 100. This is merely an example, and the ink supply hole may be formed only in one side of a second body 200 and may be formed in each of both the first body 100 and the second body 200. In addition, FIG. 8 illustrates an example in which one ink supply hole 130 is formed in a center of one side of the first body 100, but the number and position of the ink supply holes may be freely changed by a person skilled in the art.

As described above, when the ink supply hole 130 is formed to communicate with the upper portion of the cavity 110, each of the plurality of variable manifolds 300 may change a partial flow rate of ink I by concurrently changing partial volumes of upper and lower portions (i.e., second and first spaces 112 and 111) of the cavity 110 at an arrangement position thereof.

Meanwhile, at least one ink path may be formed in a movement block 310 of the variable manifold 300 constituting the slot die 1 with the variable manifolds according to the second embodiment of the present invention.

Figure 9:
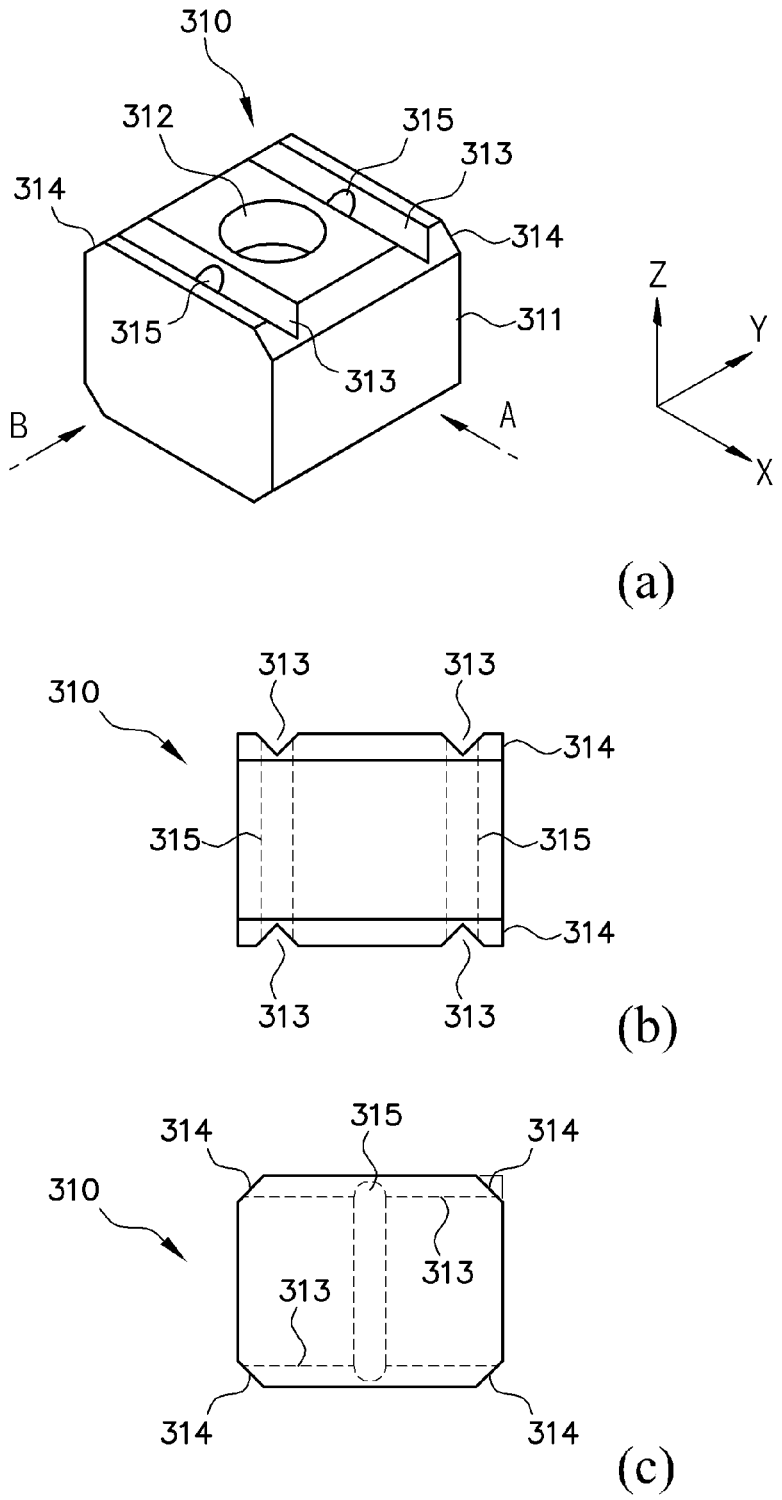
FIG. 9 is a view illustrating a structure of a movement block of a variable manifold constituting the slot die with the variable manifolds according to the second embodiment of the present invention.

FIG. 9 is a view illustrating a structure of the movement block of the variable manifold constituting the slot die with the variable manifolds according to the second embodiment of the present invention.

(a) of FIG. 9 is a perspective view illustrating a structure of the movement block 310 constituting the variable manifold 300. (b) of FIG. 9 is a view illustrating a shape of the movement block 310, when viewed in direction A. (c) of FIG. 9 is a view illustrating a shape of the movement block 310, when viewed in direction B.

As illustrated in (a) of FIG. 9, the movement block 310 may have a substantially rectangular parallelepiped shape and may have a coupling hole 312 formed in an upper end thereof, to which a position adjustment portion 320 is coupled. In addition, at least one ink path 313, 314, or 315 may be formed in the movement block 310 in at least one of a width direction of the first body 100 (i.e., a transfer direction of a substrate (S of FIG. 10) and a ±X direction in an example of FIG. 9), a length direction of the first body 100 (i.e., a width direction of the substrate (S of FIG. 10) and a ±Y direction in an example of FIG. 9), and a direction toward an discharge port H (i.e., a ±Z direction in an example of FIG. 9).

When the movement block 310 vertically reciprocate in the cavity 110, the ink path 313, 314, or the 315 may function to allow the ink I to flow such that the ink I introduced through the ink supply hole 130 is uniformly distributed to the upper portion, i.e., the second space 112 and lower portion, i.e., the first space 111 of the cavity 110.

For example, as illustrated in (a) and (b) of FIG. 9, a first ink path 313 may be formed in at least one of an upper end and a lower end of the movement block 310 in the width direction of the first body 100 (i.e., the transfer direction of the substrate (S of FIG. 10) and the ±X direction in the example of FIG. 9). When the movement block 310 vertically reciprocate in the cavity 110, the first ink path 313 allows the ink I to smoothly flow in the width direction of the first body 100.

In addition as illustrated in (a) and (c) of FIG. 9, a second ink path 314 may be formed in at least one of four corners of the movement block 310 in the length direction of the first body 100 (i.e., the width direction of the substrate (S of FIG. 10) and the ±Y direction in the example of FIG. 9). When the movement block 310 vertically reciprocate in the cavity 110, the second ink path 314 allows the ink I to smoothly flow in the length direction of the first body 100.

Furthermore, as illustrated in (a) to (c) of FIG. 9, a third ink path 315 may be formed so as to path through the movement block 310 in the direction toward the discharge port H (i.e., the ±Z direction in the example of FIG. 9). When the movement block 310 vertically reciprocate in the cavity 110, the third ink path 315 allows the ink I to smoothly flow in the upper portion and the lower portion of the cavity 110 in the direction toward the discharge port H.

On the other hand, (a) to (c) of FIG. 9 illustrate an example in which two first ink paths 313 are formed in each of the upper end and the lower end of the movement block 310, the second ink path 314 is formed in a chamfered shape in each of four corners of the movement block 310, and the third ink path 315 is formed in a shape passing through the movement block 310. However, the present invention is not limited thereto, and the number, formation direction, and arrangement type of the ink paths may be freely changed by a person skilled in the art.

In addition, (a) to (c) of FIG. 9 illustrate an example in which the third ink path 315 has a shape of a simple through-hole passing through the movement block 310. However, the third ink path 315 may be formed in various shapes such as a taper shape and a venturi shape.

Hereinafter, a controlling method of a slot die 1 with variable manifolds according to embodiments of the present invention as configured above will be described with reference to FIGS. 10 to 12.

Figure 10:
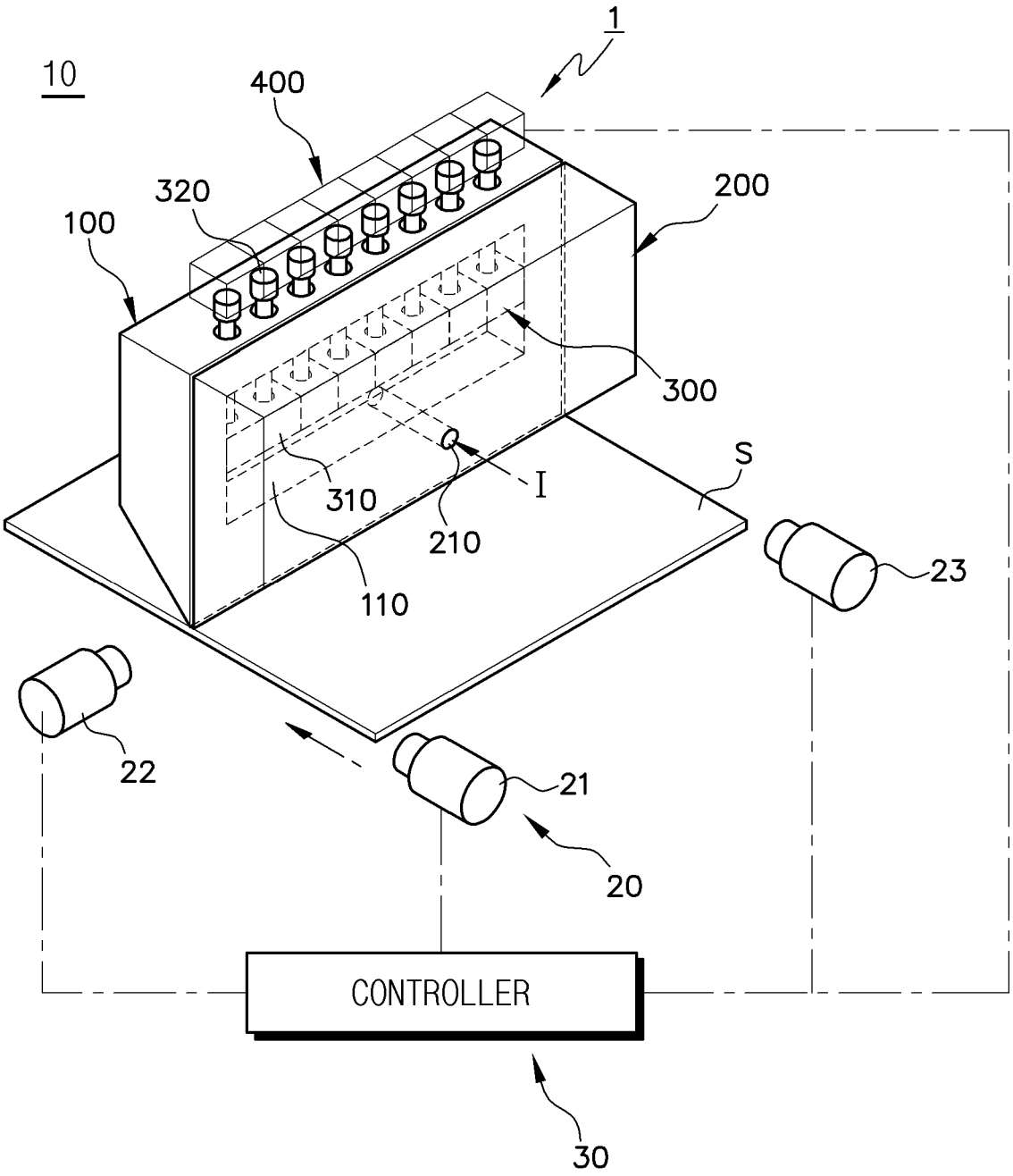
FIG. 10 is a schematic perspective view illustrating a substrate coating apparatus including the slot die with the variable manifolds according to embodiments of the present invention.

FIG. 10 is a schematic perspective view illustrating a substrate coating apparatus including the slot die with the variable manifolds according to embodiments of the present invention.

As shown in FIG. 10, a substrate coating apparatus 10 including the slot die 1 with the variable manifolds according to embodiments of the present invention may include the slot die 1, one or more profile measurement units 20, and a controller 30.

One or more profile measurement units 20 may measure a cross-sectional profile of ink I applied on a substrate S during a coating process. Preferably, the profile measurement units 20 may include a first profile measurement unit 21 disposed in at least one of a front end and a rear end of the slot die 1 in a transfer direction of the substrate S and a second profile measurement unit 22 disposed in at least one of both ends of the slot die 1.

The first profile measurement unit 21 and the second profile measurement unit 22 constituting the substrate coating apparatus 10 may measure a cross-sectional profile of the ink I coated on the substrate S. An actual cross-sectional profile of the ink I measured through the first profile measurement unit 21 and the second profile measurement unit 22 is a reference for determining a state of the ink I coated on the substrate S.

Preferably, the profile measurement units 20 may include a vision camera configured to acquire an image of the cross-sectional profile of the ink I by photographing a space between the slot die 1 and the substrate S. However, the present invention is not limited thereto, and various methods such as infrared measurement, X-ray measurement, light transmittance measurement, and sheet resistance measurement may be used.

Meanwhile, FIG. 10 illustrates an example in which two first profile measurements units 21 and one second profile measurements 22 are provided, but the number and arrangement type of the first profile measurement units 21 and the second profile measurement units 22 may be freely changed by a person skilled in the art.

The controller 30 may be connected to the slot die 1 and the profile measurement units 20 and may control operation of the slot die 1 based on a comparison result between a cross-sectional profile measured through the profile measurement units 20 and a reference profile.

Figure 11:
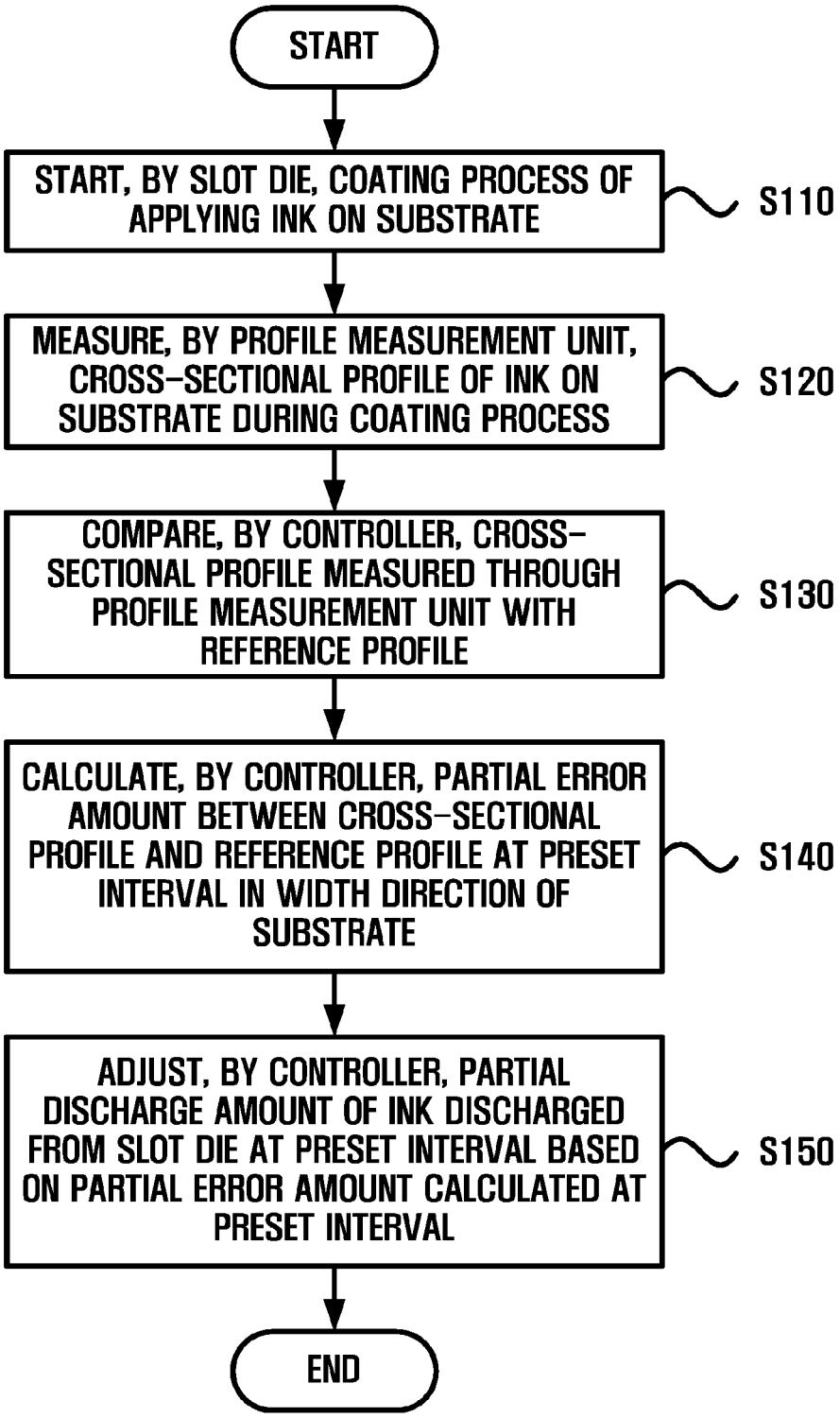
FIG. 11 is a flowchart of a controlling method of a slot die with variable manifolds according to embodiments of the present invention.

FIG. 11 is a flowchart of the controlling method of the slot die with the variable manifolds according to embodiments of the present invention. FIG. 12 is a view illustrating operation of the slot die with the variable manifolds according to embodiments of the present invention.

Figure 12:
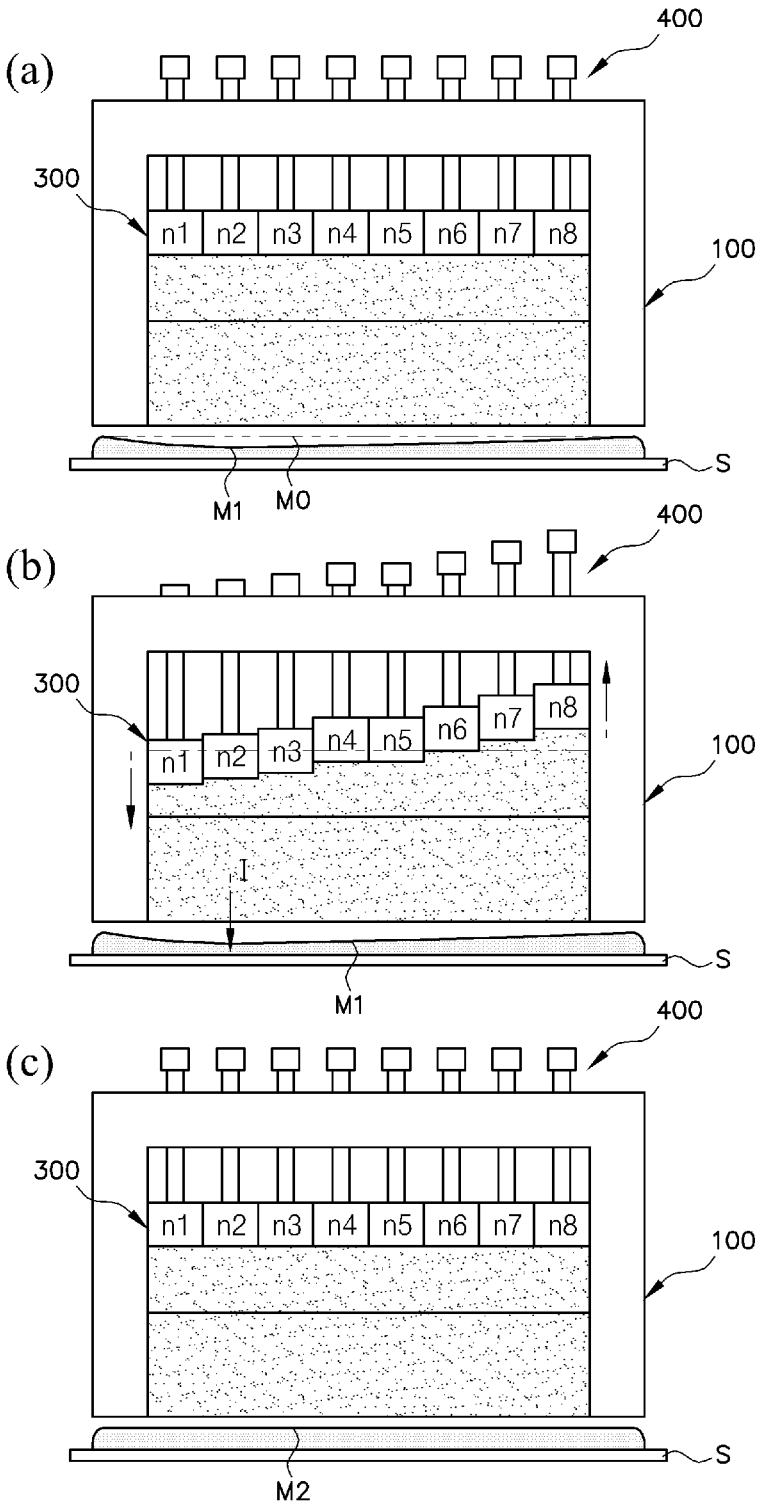
FIG. 12 is a view illustrating operation of a slot die with variable manifolds according to embodiments of the present invention.

(a) of FIG. 12 is a view illustrating a state of the ink I coated on the substrate S. (b) of FIG. 12 is a view illustrating a state in which each of a plurality of variable manifolds 300 is driven. (c) of FIG. 12 is a view illustrating a state in which the state of the ink I coated on the substrate S is changed by driving each of the plurality of variable manifolds 300.

First, as illustrated in FIG. 11, in the substrate coating apparatus 10 including the slot die 1 with the variable manifolds according to embodiments of the present invention, the slot die 1 may start a coating process of applying the ink I on the transported substrate S (S110).

The profile measurement units 20 may measure a cross-sectional profile of the ink I applied on the substrate S in real time during a substrate coating process.

As illustrated in FIG. 11 and (a) of FIG. 12, the controller 30 may compare an actual cross-sectional profile M1 of the ink I measured through the profile measurement units 20 with a preset reference profile M0 (S130). Then, as a comparison result, the controller 30 may calculate a partial error amount between the cross-sectional profile M1 and the reference profile M0 at a present interval, i.e., a gap between the plurality of variable manifolds 300 in a width direction of the substrate S (S140).

As illustrated in FIG. 11 and (b) of FIG. 12, the controller 30 may adjust a partial discharge amount of the ink discharged from the slot die at the preset interval according to the partial error amount calculated at the preset interval in the width direction of the substrate S.

That is, as illustrated in (b) of FIG. 12, in order to align the actual cross-section profile M1 with the reference profile M0, the controller 30 may control each of a plurality of manifold drivers 400 based on the partial error amount calculated at the preset interval to individually drive variable manifolds n1, n2, n3, n4, n5, n6, n7, and n8 to a desired degree at all or some positions of the plurality of variable manifolds 300, thereby adjusting a partial discharge amount of the ink I by changing a partial volume of the cavity 110 at a corresponding position.

Therefore, as illustrated in (c) of FIG. 12, the slot die 1 may uniformly coat the ink I in the width direction of the substrate S.

As described above, in the slot die 1 with the variable manifolds according to embodiments of the present invention, each of the plurality of variable manifolds 300 may be individually driven according to a state of the ink I coated on the substrate S during a substrate coating process, thereby improving coating uniformity of the ink I in the width direction of the substrate S by controlling a partial discharge amount of the ink I.

Meanwhile, while the slot die 1 used in a coating apparatus performing a coating process on a substrate has been described as an example in the present invention, the scope of application of the present invention is not limited thereto. The present invention can be applied to various process and technical fields as long as it is a device for performing a process by discharging the ink I on the substrate.

Although the invention has been shown and described with respect to the preferred embodiments, and specific terms have been used, the preferred embodiments and specific terms are used in their general meaning only, in order to easily describe the technical content of the present invention and to facilitate the understanding of the present invention, and are not intended to limit the scope of the present invention. It will be understood by those skilled in the art that various changes and modifications may be made without departing from the spirit and scope of the invention as defined in the following claims.

The invention claimed is:

1. A slot die comprising:

a first body extended in a first direction corresponding to a width of a substrate and having a cavity configured to accommodate ink supplied from outside wherein the cavity is elongated in the first direction with a height and a first width;

a second body having a length corresponding to the first body;

a plurality of variable manifolds disposed in the cavity in the first direction, wherein each of the plurality of variable manifolds has a movement block, and the movement block is configured to reciprocate in a height direction of the cavity and divides the cavity into a first space and a second space;

a plurality of manifold drivers disposed at one side of the first body and connected to the plurality of variable manifolds to allow the plurality of variable manifolds to reciprocate, respectively; and a discharge port coupled to the first space, extended in the height direction of the cavity, and formed in at least one of the first body and the second body, wherein each of the plurality of variable manifolds is independently driven according to a state of the ink coated on the substrate, and a change of a position of the movement block in the height direction of the cavity adjusts a partial discharge amount of the ink discharged from the discharge port by changing a partial volume of the first space, and wherein the movement blocks in the cavity reciprocate in the height direction of the cavity while abutting an inner wall of the cavity and have a constant length of a second width which corresponds to the first width of the cavity.

2. The slot die of claim 1, wherein the movement block has the constant length of the second width, which is normal to the height direction.

3. The slot die of claim 1, wherein each of the plurality of manifold drivers includes a first driving actuator configured to generate a rotational driving force, and a position adjustment assembly including a ball screw member having one end connected to the movement block and the other end connected to a rotary drive shaft of the first driving actuator.

4. The slot die of claim 1, wherein each of the plurality of manifold drivers includes a driving actuator configured to generate a linear driving force, and a position adjustment assembly including a drive shaft member having one end connected to the movement block and the other end connected to a linear drive shaft of the driving actuator.

5. The slot die of claim 1, wherein at least one of the first body and the second body has at least one ink supply hole formed in one side thereof, which is configured to supply the ink supplied from the outside of the slot die to the cavity.

6. The slot die of claim 5, wherein the at least one ink supply hole communicates with the first space with respect to each of the plurality of variable manifolds, and each of the plurality of variable manifolds changes a partial volume of the first space at an arrangement position thereof.

7. The slot die of claim 5, wherein the at least one ink supply hole communicates with an upper portion of the cavity with respect to each of the plurality of variable manifolds, and each of the plurality of variable manifolds concurrently changes partial volumes of the upper portion and a lower portion of the cavity at an arrangement position thereof.

8. The slot die of the claim 7, wherein the movement block provided in each of the plurality of variable manifolds has at least one ink path formed in at least one of a width direction of the first body, a length direction of the first body, and a direction toward the discharge port.

9. The slot die of claim 1, further comprises a shim plate disposed between the first body and the second body and having one or more slits which communicate with the cavity, open in a direction toward the discharge port.

10. The slot die of claim 1, wherein a plurality of variable profile measurement detectors included with the slot die are configured to measure a cross-sectional profile of the ink coated on the substrate;

wherein a controller connected to the slot die, and the plurality of variable profile measurement detectors are configured to control an operation of the slot die based on a comparison result between the cross-sectional profile and a reference profile;

the controller is configured to automatically calculate a partial error amount between the cross-sectional profile and the reference profile and adjust a partial discharge amount of the ink discharged from the slot die at a present interval based on the partial error amount calculated at the preset interval.

* * * * *